US009939209B2

(12) United States Patent
Yokoo et al.

(10) Patent No.: US 9,939,209 B2
(45) Date of Patent: Apr. 10, 2018

(54) GAS COOLER

(75) Inventors: Kazutoshi Yokoo, Hiroshima (JP); Shigenari Horie, Hiroshima (JP); Masashi Yoshikawa, Hiroshima (JP); Tomoaki Takeda, Hiroshima (JP); Koichi Mizushita, Hiroshima (JP); Kazunari Tanaka, Hiroshima (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1901 days.

(21) Appl. No.: 13/124,735

(22) PCT Filed: Feb. 16, 2010

(86) PCT No.: PCT/JP2010/000949

§ 371 (c)(1),
(2), (4) Date: Jul. 29, 2011

(87) PCT Pub. No.: WO2010/095419

PCT Pub. Date: Aug. 26, 2010

(65) Prior Publication Data

US 2011/0277960 A1 Nov. 17, 2011

(30) Foreign Application Priority Data

Feb. 23, 2009 (JP) ..... 2009-039006

(51) Int. Cl.
*F28D 7/10* (2006.01)
*F28D 1/04* (2006.01)
(Continued)

(52) U.S. Cl.
CPC . *F28F 1/32* (2013.01); *F28D 7/16* (2013.01)

(58) Field of Classification Search
CPC .... F28F 1/325; F28F 1/32; F28D 7/16; F28D 7/00
(Continued)

(56) References Cited

U.S. PATENT DOCUMENTS 4,459,917 A * 7/1984 Michael et al. ..... 165/151
4,836,277 A 6/1989 Koehler
(Continued)

FOREIGN PATENT DOCUMENTS

EP 0 213 448 3/1987
FR 2 410 237 6/1979
(Continued)

OTHER PUBLICATIONS

International Preliminary Report on Patentability and Written Opinion of the International Searching Authority dated Sep. 22, 2011 in International (PCT) Application No. PCT/JP2010/000949.
(Continued)

*Primary Examiner* — Frantz Jules
*Assistant Examiner* — Joseph Trpisovsky
(74) *Attorney, Agent, or Firm* — Wenderoth, Lind & Ponack, L.L.P.

(57) ABSTRACT

A gas cooler (10) which is provided with a heat exchanger (6), cools a gas to be cooled, which is introduced from the outside, by performing heat exchange between the gas to be cooled and the heat exchanger, and discharges the cooled gas to the outside. The heat exchanger includes: a plurality of heat transfer fins (8) which are placed side by side via a prescribed gap therebetween, the gas to be cooled flowing through the gaps; and heat transfer tubes (7) which pierce through the plurality of heat transfer fins and are provided in a plurality of rows along the direction in which the gas to be cooled flows. The outside diameter $d_o$ of the heat transfer tubes is 20 to 30 mm.

7 Claims, 8 Drawing Sheets

(51) Int. Cl.

| | |
|---|---|
| ***F28D 7/02*** | (2006.01) |
| ***F28F 1/10*** | (2006.01) |
| ***F28F 1/32*** | (2006.01) |
| ***F28D 7/16*** | (2006.01) |

(58) Field of Classification Search
USPC ..... 165/151, 157, 163, 166, 164, 165, 172, 165/104.11
See application file for complete search history.

(56) References Cited

U.S. PATENT DOCUMENTS

| | | | | |
|---|---|---|---|---|
| 5,323,849 | A * | 6/1994 | Korczynski et al. | 165/158 |
| 5,404,942 | A * | 4/1995 | Patel | 165/179 |
| 5,425,414 | A * | 6/1995 | Bradley et al. | 165/150 |
| 5,799,725 | A * | 9/1998 | Bradley et al. | 165/150 |
| 6,173,763 | B1 * | 1/2001 | Sano et al. | 165/133 |
| 6,192,974 | B1 * | 2/2001 | Boedecker | 165/165 |
| 2005/0061494 | A1 * | 3/2005 | Tsuji et al. | 165/173 |
| 2008/0105408 | A1 * | 5/2008 | Zhang et al. | 165/104.33 |
| 2008/0236134 | A1 * | 10/2008 | Krueger et al. | 60/39.182 |

FOREIGN PATENT DOCUMENTS

| | | | | |
|---|---|---|---|---|
| GB | 2 011 604 | | 7/1979 | |
| JP | 63-003186 | | 1/1988 | |
| JP | 4-155189 | | 5/1992 | |
| JP | 7-49189 | | 2/1995 | |
| JP | 07049189 | A * | 2/1995 | F28F 1/32 |
| JP | 8-136177 | | 5/1996 | |
| JP | 2000-146305 | | 5/2000 | |
| JP | 2000-274982 | | 10/2000 | |
| JP | 2002243383 | * | 2/2001 | F28F 1/32 |
| JP | 2002-243383 | | 8/2002 | |
| JP | 2002-257485 | | 9/2002 | |
| JP | 2004-245532 | | 9/2004 | |
| JP | 2005-288502 | | 10/2005 | |
| JP | 2008-065412 | | 3/2008 | |
| JP | 2008-256303 | | 10/2008 | |
| KR | 10-2002-0052606 | | 7/2002 | |

OTHER PUBLICATIONS

Korean Office Action dated Sep. 19, 2012 in corresponding Korean Application No. 10-2011-7009546 with English translation.

Supplementary European Search Report dated Dec. 19, 2012 in corresponding European Patent Application No. 10743549.7.

International Search Report dated Mar. 23, 2010 in International (PCT) Application No. PCT/JP2010/000949.

Office Action dated Jun. 11, 2014 in corresponding Japanese patent application No. 2011-500504 (with English translation).

* cited by examiner

GAS COOLER

BACKGROUND OF THE INVENTION

1. Technical Field

The present invention relates to a gas cooler which cools high-temperature gases discharged from a gas compressor and the like and, more particularly, to a gas cooler which permits downsizing by improving the heat transfer performance of a heat exchanger.

2. Description of the Related Art

A gas cooler is used to cool gases heated to high temperatures of not less than 100° C. discharged from a gas compressor. This gas cooler is provided with a heat exchanger which allows heat to be exchanged between high-temperature gases and a cooling medium. The type of this heat exchanger is classified as the shell and tube type. The bare tube type (for example, Japanese Patent Laid-Open No. 2008-65412 and Japanese Patent Laid-Open No. 2008-256303) and the fin tube type are known as heat exchanger tubes. In the bare tube type, it is necessary to increase the number of heat transfer tubes or lengthen the length of heat transfer tubes in order to increase the heat transfer area, and this type has the drawback that the size of the gas cooler increases. In particular, with the capacity of a gas compressor increasing, it is necessary to cool high-temperature gases with higher efficiencies in the same gas cooler size, and for this necessity, a heat exchanger of the fin tube type can improve heat transfer performance while restraining an increase in size to a minimum because the heat transfer area can be increased only by changing the fin pitch.

However, because there is a limit to reducing the fin pitch, also in a heat exchanger of the fin tube type, it is desired that heat transfer performance be improved by methods other than adjusting the fin pitch.

A heat exchanger of the fin tube type is, as is well known, used also in air conditioners. Some proposals to improve heat transfer performance have been made in a heat exchanger of the fin tube type used in air conditioners. For example, Japanese Patent Laid-Open No. 63-3186 proposes a heat exchanger of the fin tube type in which if the outside diameter of a heat transfer tube is denoted by Do, the arrangement pitch of heat transfer tubes in the flow direction of a gas to be cooled is denoted by L1 and the arrangement pitch of heat transfer tubes in a direction perpendicular to the flow direction of the gas to be cooled is denoted by L2, then $1.2\ D_o \leq L1 \leq 1.8\ D_o$ and $2.6\ D_o \leq L2 \leq 3.3\ D_o$ are satisfied. Japanese Patent Laid-Open No. 2004-245532 proposes that the width W of fins should be $22.2 \leq W \leq 26.2$ mm.

SUMMARY OF THE INVENTION

1. Problems to be Solved by Invention

However, the proposals in JP 63-3186 and JP 2004-245532, etc. seem to cover mainly a heat exchanger for air conditioners and do not cover gases to be cooled which have temperatures of more than 100° C., and it was unclear whether it is possible to ensure prescribed heat transfer performance as a heat exchanger for compressors.

The present invention was devised on the basis of technical problems with such a gas cooler for compressors, and the object of the invention is to improve the heat transfer performance of a gas cooler provided with a heat exchanger of the fin tube type.

2. Means to Solve the Problems

The present inventors carried out investigations of the specifications of heat exchangers in order to achieve the above-described object, and found that by setting a specific range for the outside diameter of heat transfer tubes, it is possible to obtain high heat transfer coefficients while reducing pressure losses in the cooling of a gas to be cooled which has temperatures of the order of 100 to 150° C. The present invention is based on this finding, and provides a gas cooler which is provided with a heat exchanger, cools a heated gas to be cooled, which is introduced from the outside, by performing heat exchange between the gas to be cooled and the heat exchanger, and discharges the cooled gas to the outside. The heat exchanger comprises: a plurality of heat transfer fins which are placed side by side via a prescribed gap therebetween, the gas to be cooled flowing through the gap; and heat transfer tubes which pierce through the plurality of heat transfer fins and are provided in a plurality of rows along the direction in which the gas to be cooled flows. The outside diameter $d_o$ of the heat transfer tubes is 20 to 30 mm.

In the gas cooler of the present invention, if the pitch of the heat transfer tubes in a direction orthogonal to the direction in which the gas to be cooled flows is denoted by $S_1$ and the pitch of the heat transfer tubes in the direction in which the gas to be cooled flows is denoted by $S_2$, then $S_1$ is 30 to 50 mm and $S_2$ is 30 to 50 mm, which is favorable for obtaining high heat transfer coefficients while reducing pressure losses.

And in the gas cooler of the present invention, it is preferred for an improvement in the heat transfer coefficient that the heat transfer fins and the heat transfer tubes be joined via a filling material.

Furthermore, it is preferred that in the gas cooler of the present invention, the filling material be a thermally conductive adhesive.

In the gas cooler of the present invention, it is favorable for obtaining a high contact heat transfer coefficient that the outside diameter of the heat transfer tubes is expanded by pressing a die into the heat transfer tubes and that the tube expansion ratio of the heat transfer tubes is 0.3 to 1.5%. The tube expansion ratio (%)={outside diameter of heat transfer tube after tube expansion $d_{TO2}$−inside diameter of heat transfer fin before tube expansion $d_{fin1}$}/inside diameter of heat transfer fin before tube expansion $d_{fin1}$×100≅{(outside diameter of die $d_D$+wall thickness of heat transfer tube $\Delta d_T$)−inside diameter of heat transfer fin before tube expansion $d_{fin1}$}/inside diameter of heat transfer fin before tube expansion $d_{fin1}$×100.

3. Advantageous Effects of the Invention

According to the present invention, it is possible to obtain high heat transfer coefficients while reducing pressure losses and, therefore, it is possible to sufficiently cool high-temperature gases to be cooled even if a gas cooler (a heat exchanger) is downsized.

DETAILED DESCRIPTION OF THE INVENTION

Hereinafter, the present invention will be described in detail on the basis of an embodiment shown in the accompanying drawings.

Figure 1:
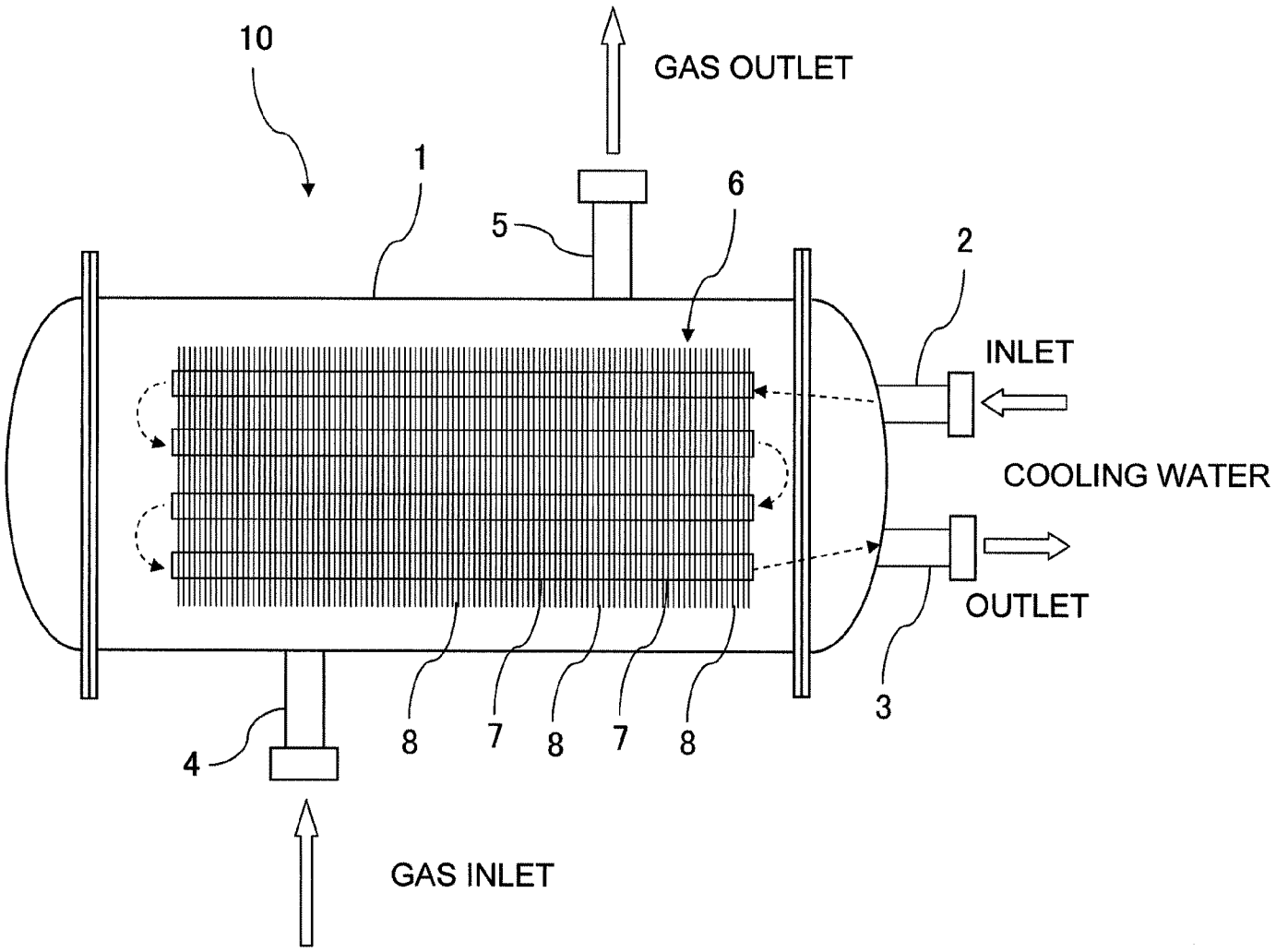
FIG. 1 is a diagram showing a schematic arrangement of a gas cooler in this embodiment.

FIG. 1 is a diagram showing a schematic arrangement of a gas cooler 10 in this embodiment.

The gas cooler 10 is provided with a heat exchanger 6 of the fin tube type which cools a process gas (a gas to be cooled) supplied to, for example, a gas compressor (not shown) with cooling water (a cooling medium).

The gas cooler 10 is provided with a gas cooler body 1 formed in the shape of a horizontal drum, and on one end side of the gas cooler body 1 in the longitudinal direction thereof, there are provided a cooling water inlet 2 and a cooling water outlet 3. The gas cooler 10 is such that on an outer circumferential surface of the gas cooler body 1, there are formed a gas inlet 4 and a gas outlet 5 in open form.

The heat exchanger 6 is provided in the interior of the gas cooler body 1. The heat exchanger 6 is provided with a plurality of heat transfer fins 8 which are placed side by side via a prescribed gap therebetween along the longitudinal direction of the gas cooler body 1, a process gas flowing through the gap, and heat transfer tubes 7 which pierce through the plurality of heat transfer fins 8 and are provided in a plurality of rows along the direction in which the gas to be cooled flows.

Although materials from which the heat transfer tubes 7 and the heat transfer fins 8 are formed are not limited in the present invention, the following materials are desirable.

The heat transfer tubes 7 are formed from SUS304, cupronickel alloys, titanium alloys, copper materials and the like.

It is preferred that the heat transfer fins 8 be formed from aluminum (including alloys) or copper (including alloys). As aluminum, 1000 series alloys (in particular, 1050 alloys) of pure aluminum series excellent in formability and thermal conductivity are desirable.

Figure 2:
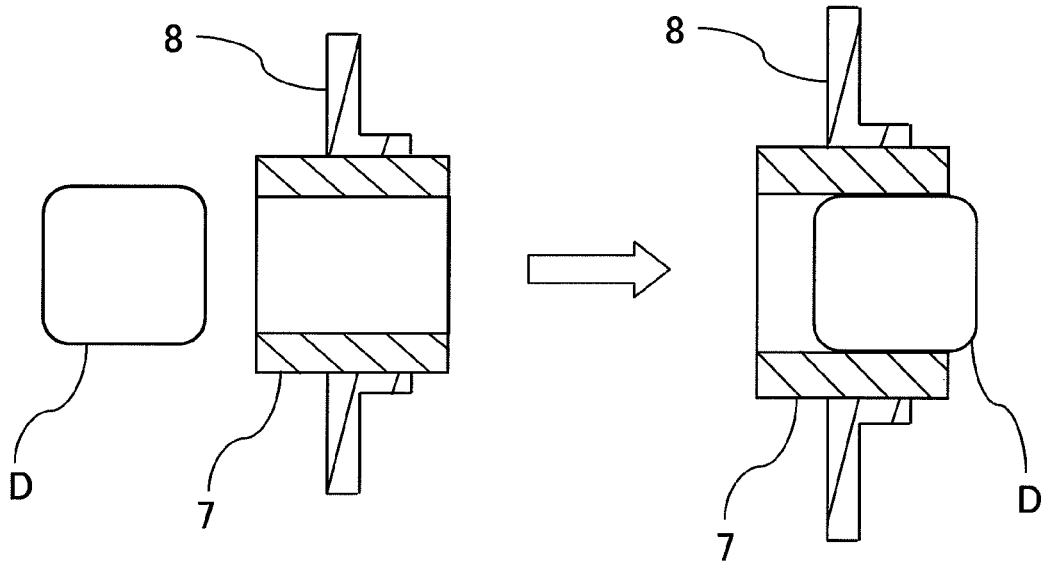
FIG. 2 is a sectional view showing a method of joining a heat transfer tube and a heat transfer fin according to this embodiment.

In the heat exchanger 6, the joining of the heat transfer tubes 7 and the heat transfer fins 8 may be performed by brazing. However, the tube expanding method which involves expanding the diameter of the heat transfer tubes 7 is desirable in consideration of cost and because the brazing of aluminum alloys and stainless steels is difficult. FIG. 2 shows an image of the tube expanding method. After the insertion of a heat transfer tube 7 into a through hole of a heat transfer fin 8, a die D is pressed into the heat transfer tube 7 and the diameter of the heat transfer tube 7 is expanded, whereby plastic deformation is caused to occur in the heat transfer tube 7 and the heat transfer fin 8 and joining is performed.

Figure 3:
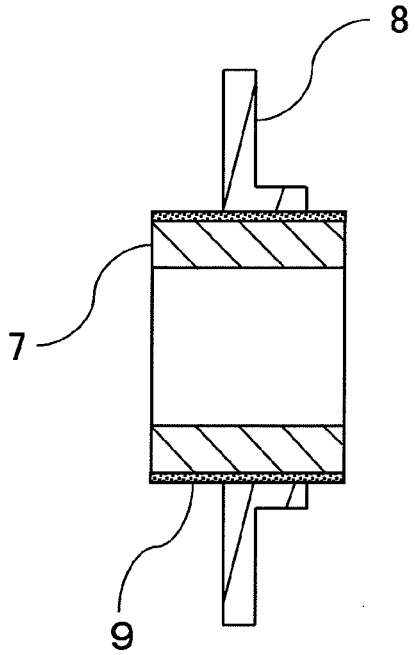
FIG. 3 is a sectional view of a portion where a heat transfer tube and a heat transfer fin are joined via a filling material according to this embodiment.

In joining the heat transfer tube 7 and the heat transfer fin 8 by the tube expanding method, as shown in FIG. 3, it is desirable for improving the heat transfer performance between the heat transfer tube 7 and the heat transfer fin 8 that a filling material 9 be interposed between the heat transfer tube 7 and the heat transfer fin 8. In the case of the tube expanding method, plastic deformation occurs in the heat transfer tube 7 and the heat transfer fin 8. However, microscopically, this deformation occurs irregularly and hence a gap may be formed between the heat transfer tube 7 and the heat transfer fin 8. Therefore, the gap is filled in by interposing the filling material 9 between the heat transfer tube 7 and the heat transfer fin 8, whereby the effective heat transfer area is expanded, permitting an improvement in heat transfer performance.

It is preferred that a thermally conductive adhesive be used as the filling material 9. A thermally conductive adhesive obtained by causing a metal filler as a diathermic substance to be contained in an adhesive matrix comprising a thermosetting resin can be used as the thermally conductive adhesive. Aluminum, copper, silver and the like can be used as the metal filler. The metal filler gives sufficient thermal conductivity to the gap between the heat transfer tube 7 and the heat transfer fin 8 if it is contained in the range of the order of 30 to 50% by volume. Publicly-known substances, such as those based on epoxy resins, polyester resins, polyurethane and phenol resins, can be used as the adhesive matrix. Such thermally conductive adhesives can be set by being heated in the manufacturing stage of the heat exchanger 6 and can also be set by being brought into contact with high-temperature gases to be cooled after being incorporated into the gas cooler 10 in an unset condition.

In addition to the above-described thermally conductive adhesives, various kinds of hardeners, adhesives and the like having heat resistance to temperatures of the order of 150° C. as the filling material 9. All of these substances can fill in the gap between the heat transfer tube 7 and the heat transfer fin 8 and can give sufficient thermal conductivity to the gap between the heat transfer tube 7 and the heat transfer fin 8.

The cooling water from a cooling water supply source, which is not shown in the figure, is supplied through the cooling water inlet 2 and flows through each of the heat transfer tubes 7 in order, whereby the cooling water circulates through the interior of the heat exchanger 6 and is thereafter discharged from the cooling water outlet 3. The cooling water flowing through the heat transfer tubes 7, which has undergone heat exchange, has temperatures of the order of 15 to 50° C. On the other hand, the gas to be cooled (process gas) from a gas compressor (not shown), which has temperatures of the order of 100 to 150° C., is supplied through the gas inlet 4 to the inside of the gas cooler body 1, and is cooled to temperatures on the order of 15 to 50° C. after heat exchange with the cooling water flowing through the heat transfer tubes 7 in the process of passing through the heat exchanger 6, i.e., between the heat transfer fins 8. The cooled gas is supplied again from the gas outlet 5 to the gas compressor via tubes (not shown), and compression is repeated.

Figure 4A:
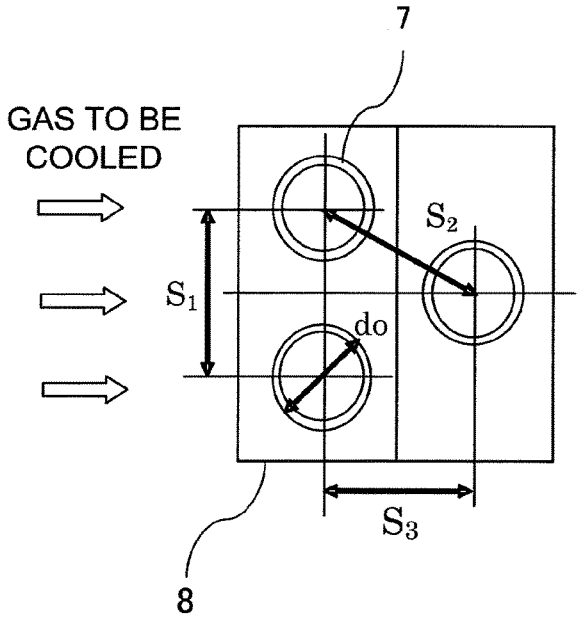
FIGS. 4A and 4B are diagrams showing the main part of a heat exchanger and indicating the outside diameter $d_o$ of heat transfer tubes 7 and the tube arrangement pitches $S_1$ and $S_2$ of the heat transfer tubes 7.
Figure 4B:
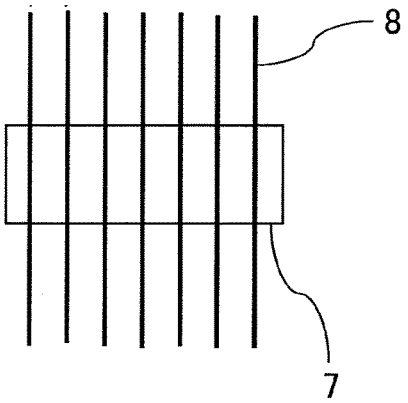

FIGS. 4A and 4B show the main part of the heat exchanger 6. FIG. 4A is a partial front view and FIG. 4B is a partial side view.

In FIG. 4A, the outside diameter of the heat transfer tubes 7 is denoted by $d_o$, and the tube arrangement pitches of the heat transfer tubes 7 are denoted by $S_1$ (orthogonal to the flow direction of the gas to be cooled) and by $S_2$ (the flow direction of the gas to be cooled). The tube arrangement pitch of the heat transfer tubes 7 in the flow direction of the gas to be cooled in the present invention is defined as $S_2$, and not as $S_3$. An investigation was made into effects exerted by these factors on the heat transfer coefficient (overall heat transfer coefficient) U of the heat exchanger 6 and pressure losses ΔP of the gas to be cooled which passes through the heat exchanger 6. The heat transfer tubes 7 were fabricated from SUS304, and the wall thickness of the heat transfer tubes 7 was approximately 1.7 mm. The heat transfer fins 8 were fabricated from 1050 alloy series aluminum, and the plate thickness was approximately 0.35 mm. And the temperature of the gas to be cooled was approximately 120° C., and the temperature of the cooling water which is caused to flow through the heat transfer tubes 7 was 45° C.

<Outside Diameter $d_o$ of Heat Transfer Tubes 7>

The heat transfer coefficient U and pressure losses ΔP were measured by changing the outside diameter $d_o$ of the heat transfer tubes 7. The trend of the heat transfer coefficient U and pressure losses ΔP is shown in FIG. 5.

Incidentally, $S_1$ and $S_2$ were set as follows:

$S_1$=40 mm, $S_2$=40 mm

Figure 5:
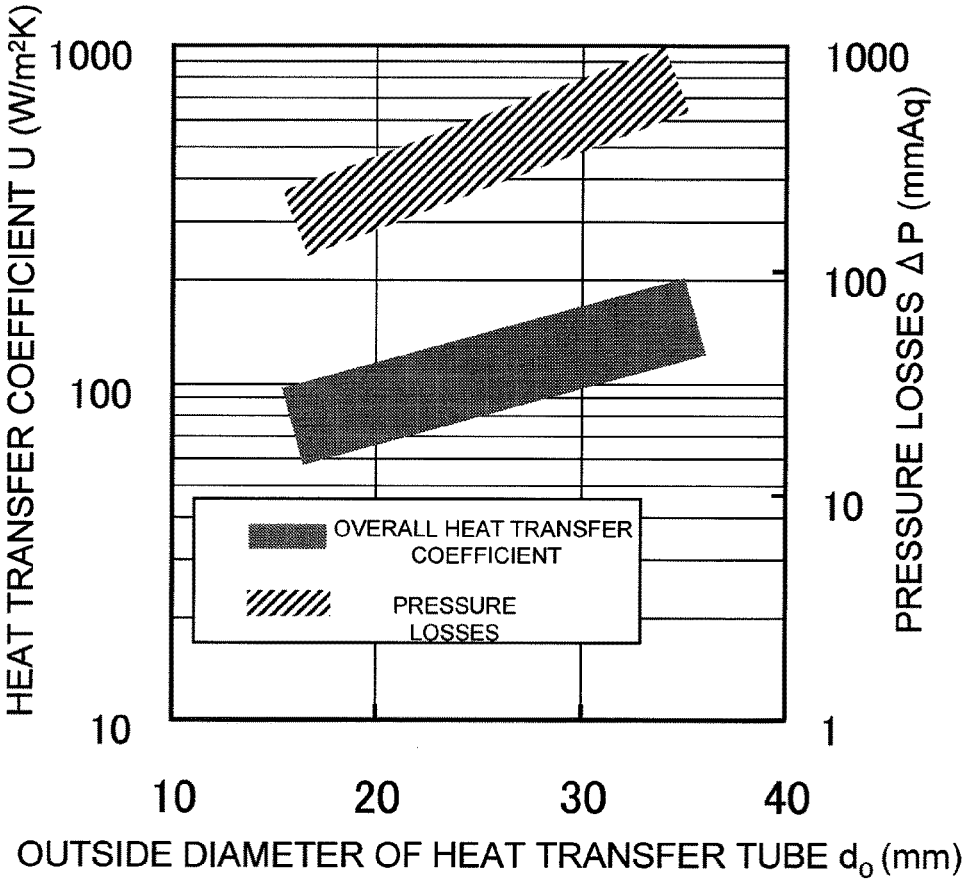
FIG. 5 is a graph showing the relationship between the outside diameter $d_o$ of heat transfer tubes and heat transfer coefficient and pressure losses.

From FIG. 5 it is apparent that the heat transfer coefficient U is improved by increasing the outside diameter $d_o$. Although the reason for this is unclear, this improvement seems to be due to the following:

(1) When the outside diameter $d_o$ of the heat transfer tubes 7 is increased, the heat transfer area of the heat transfer fins 8 per unit volume decreases, but the flow velocity of the gas to be cooled, which is flowing outside the heat transfer tubes 7, increases and the heat transfer coefficient of the surfaces of the heat transfer fins 8 and of the external surfaces of the heat transfer tubes 7 increases.

(2) Also, due to the narrowing of the tube arrangement pitch of the heat transfer tubes 7, the fin efficiency increases, the effective heat transfer area of the fins increases and the heat transfer coefficient of the tube exterior of the heat transfer tubes 7 increases, with the result that the overall heat transfer coefficient U seems to increase.

However, if the outside diameter $d_o$ of the heat transfer tubes 7 is increased, pressure losses on the gas side increase due to an increase in the flow velocity outside the tubes (on the gas side). In consideration of circulation of the cooled gas to the gas compressor, it is desired that pressure losses be as small as possible. Incidentally, a rough standard value of pressure losses is on the order of approximately 2% of the inlet process gas pressure, and it is desired that this rough standard value be on the order of approximately 200 to 1000 mmAq when the inlet pressure is on the order of 1 to 5 (kg/cm$^2$). And, allowable pressure losses become not more than these levels when pressure losses of circulation lines between the compressor and the gas cooler, and the like are taken into consideration.

In consideration of the foregoing, it is preferred that the outside diameter $d_o$ of the heat transfer tubes 7 be 20 to 30 mm. More preferred outside diameters $d_o$ of the heat transfer tubes 7 are 23 to 27 mm.

The following is another effect obtained by increasing the outside diameter $d_o$. As described above, bringing the outside diameter portion of the heat transfer tube 7 and the base portion of the heat transfer fin 8 into contact with each other is performed by the tube expanding method. The contact pressure is inversely proportional to an inverse number of the square of the diameter and is proportional to the amount of tube expansion. Therefore, the larger the outside diameter $d_o$ of the heat transfer tubes 7 is, the less the manufacture is affected by errors in the amount of expansion and hence the easier the control of manufacture is.

<Pitches $S_1$ and $S_2$ of Heat Transfer Tubes 7>

Figure 6:
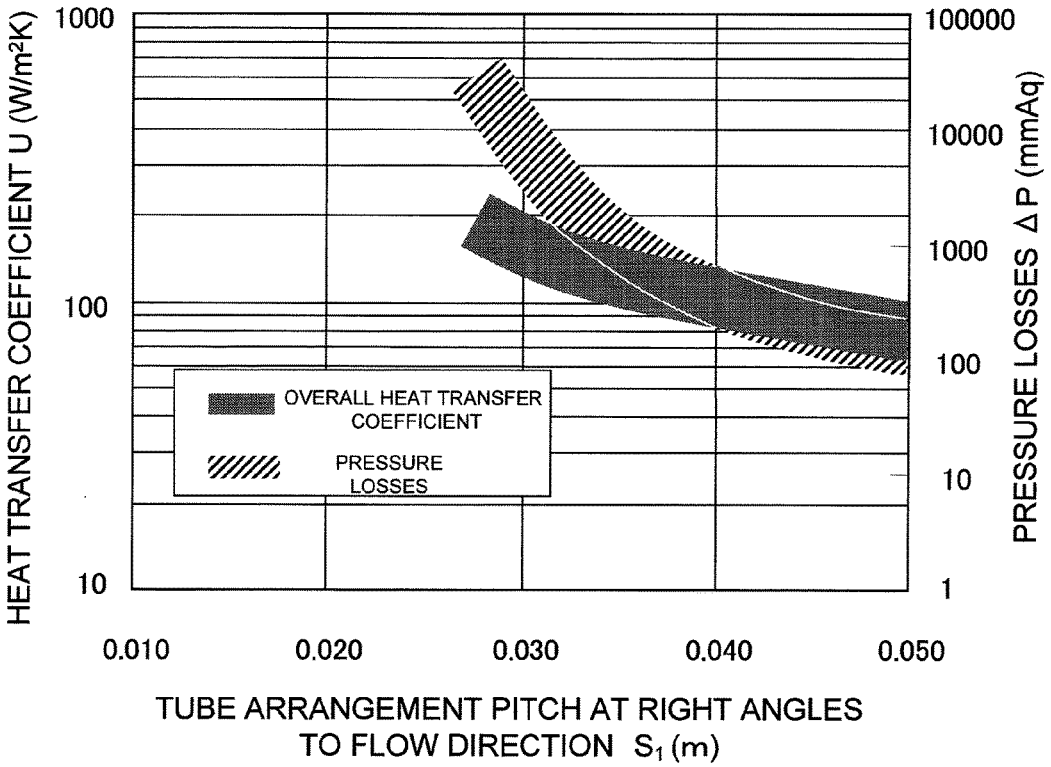
FIG. 6 is a graph showing the relationship between the tube arrangement pitch $S_1$ of heat transfer tubes and heat transfer coefficient and pressure losses.

The heat transfer coefficient U and pressure losses ΔP were measured by changing the pitch $S_1$ of the heat transfer tubes 7. The trend of the heat transfer coefficient U and pressure losses ΔP is shown in FIG. 6.

The outside diameter $d_o$ of the heat transfer tubes 7 and the pitch $S_2$ of the heat transfer tubes 7 were set as follows:

$d_o$=25.4 mm, $S_2$=40 mm

Figure 7:
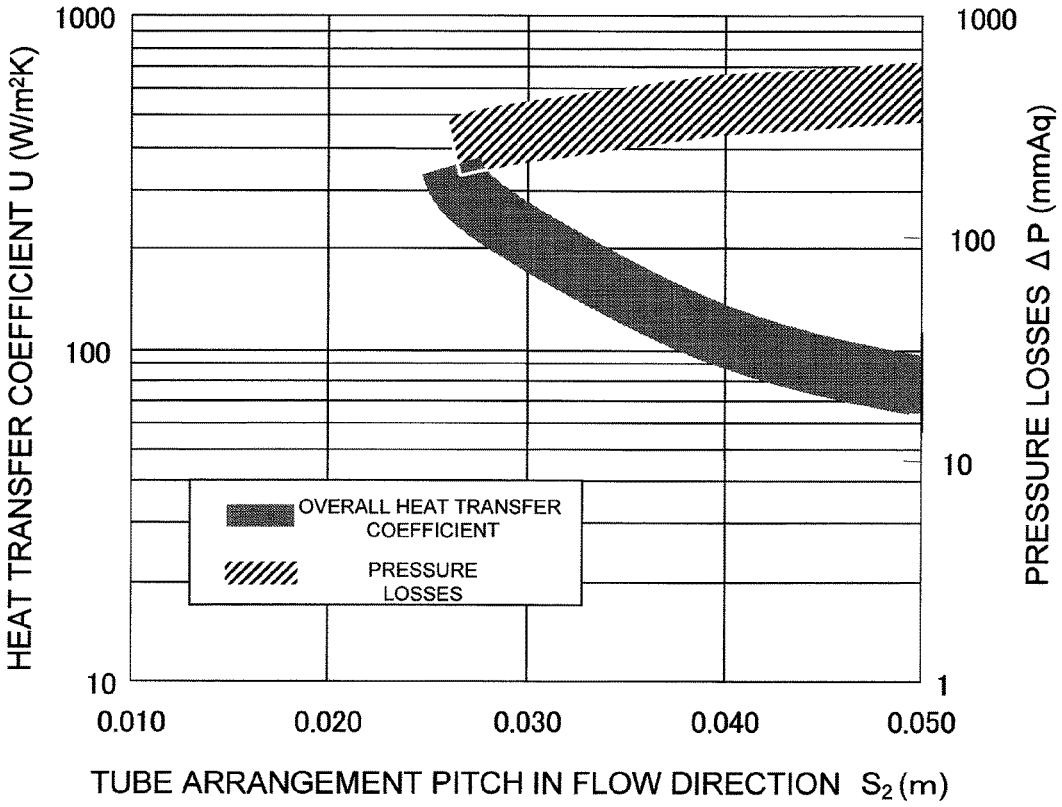
FIG. 7 is a graph showing the relationship between the tube arrangement pitch $S_2$ of heat transfer tubes and heat transfer coefficient and pressure losses.

The heat transfer coefficient U and pressure losses ΔP were measured by changing the pitch $S_2$ of the heat transfer tubes 7. The trend of the heat transfer coefficient U and pressure losses ΔP is shown in FIG. 7.

The outside diameter $d_o$ of the heat transfer tubes 7 and the pitch $S_1$ of the heat transfer tubes 7 were set as follows:

$d_o$=25.4 mm, $S_1$=40 mm

From FIG. 6, it is apparent that when the pitch $S_1$ is made narrow, the heat transfer coefficient U is improved. Similarly, when the pitch $S_2$ is made narrow, the heat transfer coefficient U is improved. This is explained as follows; that is, the flow velocity of the gas to be cooled which flows outside the heat transfer tubes 7 increases and the heat transfer coefficient U on the surfaces of the heat transfer fins 8 and the outer surfaces of the heat transfer tubes 7 increases. In the present invention, in consideration of the heat transfer coefficient U and pressure losses ΔP, the pitch $S_1$ and the pitch $S_2$ are set in the range of 30 to 50 mm. Preferred pitches $S_1$ and $S_2$ are 35 to 45 mm.

<Filling Material 9>

Figure 8:
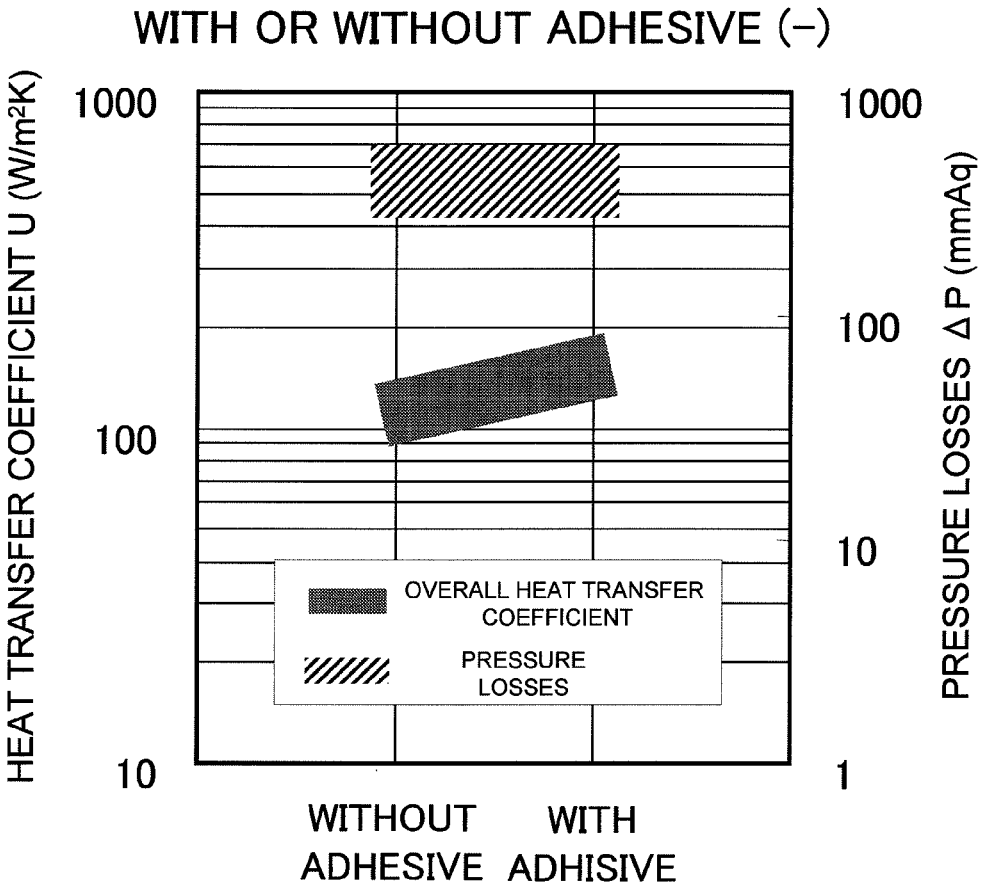
FIG. 8 is a graph showing the relationship between the existence or nonexistence of a thermally conductive adhesive and heat transfer coefficient and pressure losses.

A maximum effect obtained when a thermally conductive adhesive is applied to the gaps between the heat transfer tubes 7 and the heat transfer fins 8 was evaluated with respect to the heat transfer coefficient U and pressure losses ΔP. The result is shown in FIG. 8. Here, for the thermally conductive adhesive applied, a maximum effect was evaluated in the case where the thickness of the adhesive itself is small compared to the wall thickness of the tubes and the wall thickness of the fins and hence the thermally conductive adhesive is supposed to be capable of being neglected as heat resistance.

Incidentally, $d_o$, $S_1$ and $S_2$ were set as follows:

$d_o$=25.4 mm, $S_1$=40 mm, $S_2$=40 mm

From FIG. 8 it is apparent that, by interposing the filling material 9 between the heat transfer tubes 7 and the heat transfer fins 8, it is possible to improve the heat transfer coefficient U without reducing the contact resistance occurring between the heat transfer tubes 7 and the heat transfer fins 8 and without changing the pressure losses ΔP outside the tubes.

According to the present invention described above, it is possible to improve the heat transfer coefficient U by the order of at least approximately 20%. Therefore, it is possible to reduce the size of the gas cooler by the order of approximately 20%, simultaneously contributing also to a cost reduction.

Figure 9:
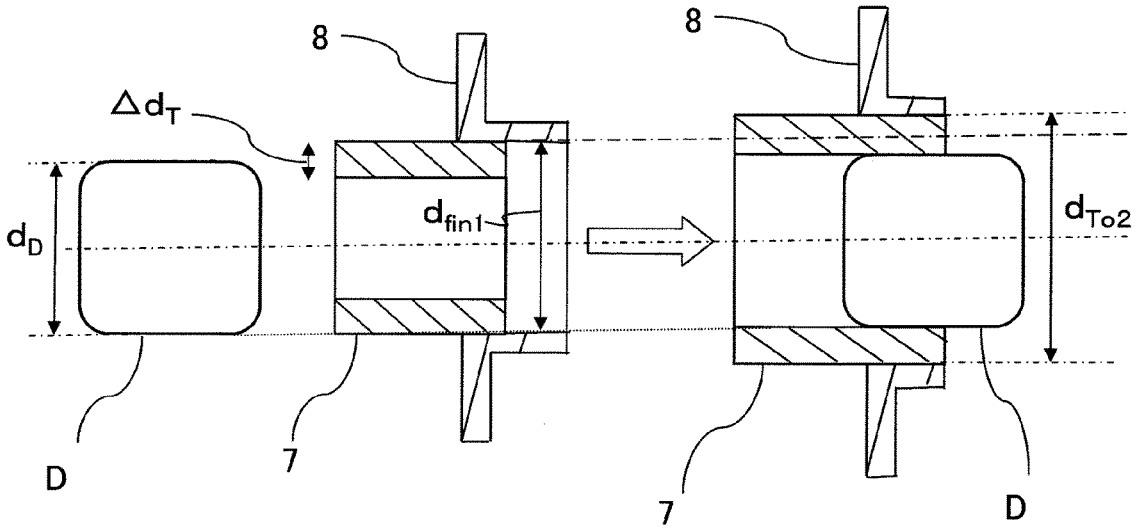
FIG. 9 is a sectional view showing the joining of a heat transfer tube and a heat transfer fin and dimensions according to this embodiment.

The thermal conductivity of the heat transfer tubes 7 and the heat transfer fins 8 can also be improved by setting the tube expansion ratio in a prescribed range in performing the tube expansion of the heat transfer tubes 7. The tube expansion ratio can be found from the relationship between the outside diameter of die $d_D$, the wall thickness of heat transfer tube $\Delta d_T$, the inside diameter of heat transfer fin before tube expansion $d_{fin1}$, and the outside diameter of heat transfer tube after tube expansion $d_{TO2}$, which are shown in FIG. 9. In the present invention, it is preferred that the tube expansion ratio introduced by the following formula be 0.3 to 1.5%.

Tube expansion ratio (%)={outside diameter of heat transfer tube after tube expansion $d_{TO2}$−inside diameter of heat transfer fin before tube expansion $d_{fin1}$}/inside diameter of heat transfer fin before tube expansion $d_{fin1}\times100\cong$\{(outside diameter of die $d_D$+wall thickness of heat transfer tube $\Delta d_T$)−inside diameter of heat transfer fin before tube expansion $d_{fin1}$}/inside diameter of heat transfer fin before tube expansion $d_{fin1}\times100$.

Figure 10:
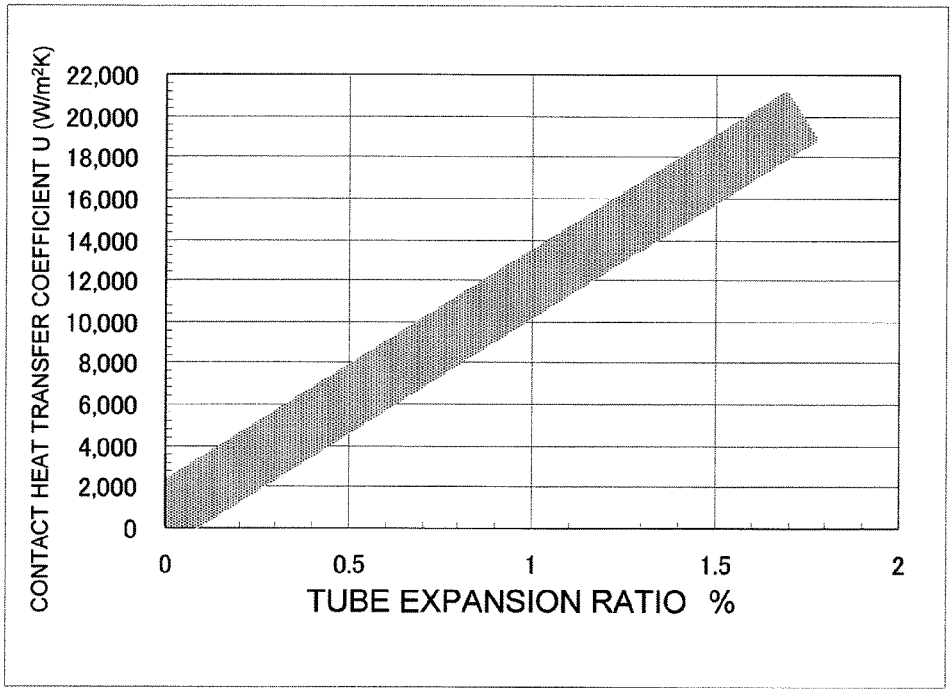
FIG. 10 is a graph showing the relationship between tube expansion ratio and contact heat transfer coefficient.

As shown in FIG. 10, the more the tube expansion ratio increases, the more the contact heat transfer coefficient between the joined heat transfer tubes 7 and the heat transfer fins 8 increases. If the contact heat transfer coefficient is less than approximately 5000 W/(m$^2$·K), contact resistance becomes predominant, and hence it is preferred that the contact heat transfer coefficient be not less than approximately 5000 W/(m$^2$·K). On the other hand, if the tube expansion ratio increases to not less than 1.5%, the elastic force with which the heat transfer fins 8 fasten the heat transfer tubes 7 decreases and the contact becomes loose. As a result, the inclination of the heat transfer fins 8 and the like occur and the distortion occurs in the heat transfer fins 8, resulting in a decrease in the dimensional accuracy. Therefore, it is preferred that the tube expansion ratio be 0.3 to 1.5%, and it is more preferred that the tube expansion ratio be 0.5 to 1.0%.

In addition to the foregoing, it is possible to make a choice from the arrangements enumerated in the above-described embodiment and to make appropriate changes to other arrangements so long as this does not deviate from the spirit of the present invention.

REFERENCE SIGNS LIST

10 . . . gas cooler
1 . . . gas cooler body
2 . . . cooling water inlet
3 . . . cooling water outlet
4 . . . gas inlet
5 . . . gas outlet
6 . . . heat exchanger
7 . . . heat transfer tube
8 . . . heat transfer fin
$d_o$ . . . outside diameter
$S_1$ . . . pitch
$S_2$ . . . pitch
$d_D$ . . . outside diameter of die
$\Delta d_T$ . . . wall thickness of heat transfer tube
$d_{fin1}$ . . . inside diameter of heat transfer fin before tube expansion
$d_{TO2}$ . . . outside diameter of heat transfer tube after tube expansion

The invention claimed is:

1. A gas cooler for cooling a heated gas having a temperature of at least 100° C. by performing heat exchange between the gas to be cooled and the heat exchanger, and discharging a cooled gas to the outside, the gas cooler including a heat exchanger comprising:

a plurality of heat transfer fins which are placed side by side via prescribed caps therebetween so that the gas to be cooled can flow through the gaps; and heat transfer tubes which pierce through the plurality of heat transfer fins and are provided in a plurality of rows along a direction in which the gas to be cooled flows, wherein an outside diameter $d_o$ of the heat transfer tubes is 20 to 30 mm, wherein a pitch of the heat transfer tubes in a direction orthogonal to the direction in which the gas to be cooled flows is denoted by $S_1$ and a pitch of the heat transfer tubes in the direction in which the gas to be cooled flows is denoted by $S_2$, wherein the outside diameter of the heat transfer tubes is expanded by pressing a die into the heat transfer tubes and the tube expansion ratio of the heat transfer tubes is 0.3 to 1.5%, where tube expansion ratio (%)={outside diameter of heat transfer tube after tube expansion $d_{TO2}$−inside diameter of heat transfer fin before tube expansion $d_{fin1}$}/inside diameter of heat transfer fin before tube expansion $d_{fin1}\times100\cong$\{(outside diameter of die $d_D$+wall thickness of heat transfer tube $\Delta d_T$)−inside diameter of heat transfer fin before tube expansion $d_{fin1}$}/inside diameter of heat transfer fin before tube expansion $d_{fin1}\times100$, wherein the pitch $S_1$ and the pitch $S_2$ of the heat transfer tubes are 35 to 45 mm.

2. The gas cooler according to claim 1, wherein the outside diameter $d_o$ of the heat transfer tubes is 23 to 27 mm.

3. The gas cooler according to claim 1, wherein the heat transfer fins and the heat transfer tubes are joined via a filling material.

4. The gas cooler according to claim 3, wherein the filling material is a thermally conductive adhesive.

5. The gas cooler according to claim 1, wherein the tube expansion ratio of the heat transfer tubes is 0.5 to 1.0%.

6. The gas cooler according to claim 2, wherein the heat transfer fins and the heat transfer tubes are joined via a filling material.

7. The gas cooler according to claim 6, wherein the filling material is a thermally conductive adhesive.

* * * * *